US011649109B2

(12) United States Patent
Qi et al.

(10) Patent No.: US 11,649,109 B2
(45) Date of Patent: May 16, 2023

(54) TOP SIDE BEAM OF CONTAINER AND CONTAINER

(71) Applicants: SINGAMAS CONTAINER HOLDINGS (SHANGHAI), LTD., Shanghai (CN); HUB CITY TERMINALS, INC., Oak Brook, IL (US); G-P MOVES FREIGHT, LLC, San Ramon, CA (US)

(72) Inventors: Jinxiang Qi, Shandong (CN); Zhiheng Chen, Shandong (CN); Jakub Cerny, Darien, IL (US); Charles Green, San Ramon, CA (US)

( * ) Notice: Subject to any disclaimer, the term of this patent is extended or adjusted under 35 U.S.C. 154(b) by 1025 days.

(21) Appl. No.: 16/066,620

(22) PCT Filed: Dec. 28, 2016

(86) PCT No.: PCT/US2016/068969
§ 371 (c)(1),
(2) Date: Jun. 27, 2018

(87) PCT Pub. No.: WO2017/117271
PCT Pub. Date: Jul. 6, 2017

(65) Prior Publication Data

US 2019/0009981 A1 Jan. 10, 2019

(30) Foreign Application Priority Data

Dec. 29, 2015 (CN) ..... 201521117324.X

(51) Int. Cl.
*B65D 90/08* (2006.01)
*B65D 90/02* (2019.01)
*B65D 88/12* (2006.01)

(52) U.S. Cl.
CPC ..... *B65D 90/08* (2013.01); *B65D 88/12* (2013.01); *B65D 90/02* (2013.01); *B65D 88/121* (2013.01)

(58) Field of Classification Search
CPC ..... B65D 90/08; B65D 90/02; B65D 88/12; B65D 88/36; E05C 3/07
(Continued)

(56) References Cited

U.S. PATENT DOCUMENTS 3,647,100 A * 3/1972 Russell-French ..... B65D 7/28 220/1.5
5,022,702 A 6/1991 Straub
(Continued)

FOREIGN PATENT DOCUMENTS

CN 200967999 Y 10/2007
CN 100441815 C 12/2008
(Continued)

OTHER PUBLICATIONS

Chinese National Intellectual Property Administration, First Office Action for application 201680077248.5, dated May 5, 2019, with translation.
(Continued)

*Primary Examiner* — Anthony D Stashick
*Assistant Examiner* — Raven Collins
(74) *Attorney, Agent, or Firm* — Quarles & Brady LLP

(57) ABSTRACT

The utility model discloses a top side beam of a container, which has a web plate that extends vertically along a height direction of the container, to increase a vertical height of the top side beam to above 100 mm. The utility model further discloses a container having the top side beam according to the utility model. The top side beam according to the utility model can effectively resist external impact, and it has a good protection function to prevent the container from being
(Continued)

damaged by an external force and then improve the overall strength of the container, thereby avoiding that the container body is punctured and ensuning integrity and security of goods in the container. In addition, the top side beam of the container according to the utility model has a simple structure, is easy to manufacture, and facilitates convenient modification of the container.

16 Claims, 10 Drawing Sheets

(58) Field of Classification Search
USPC ..... 220/1.5
See application file for complete search history.

(56) References Cited

U.S. PATENT DOCUMENTS

| | | | | |
|---|---|---|---|---|
| 6,397,550 | B1 * | 6/2002 | Walker | E04C 3/07 52/836 |
| 2002/0046540 | A1 * | 4/2002 | Weeks | E04C 3/07 52/844 |
| 2008/0028720 | A1 | 2/2008 | Bartlett | |
| 2008/0135545 | A1 * | 6/2008 | Sadkin | B65D 88/524 220/1.5 |
| 2009/0121514 | A1 | 5/2009 | Remmel | |
| 2009/0159592 | A1 * | 6/2009 | Vitalis | B65D 88/126 220/1.5 |
| 2010/0005758 | A1 | 1/2010 | Bartlett | |
| 2015/0101280 | A1 * | 4/2015 | Woolf | E04C 3/07 52/846 |
| 2017/0015498 | A1 | 1/2017 | Zhu | |

FOREIGN PATENT DOCUMENTS

| | | | | |
|---|---|---|---|---|
| CN | 101321647 | A | 12/2008 | |
| CN | 201254365 | Y | 6/2009 | |
| CN | 201276298 | Y | 7/2009 | |
| CN | 201704871 | U | 1/2011 | |
| CN | 202642576 | U | 1/2013 | |
| CN | 202642578 | U | 1/2013 | |
| CN | 205274303 | U | 6/2016 | |
| EP | 3132894 | B1 | 2/1985 | |
| GB | 2181467 | A | 4/1987 | |
| GB | 2526868 | * | 5/2014 | B65D 90/62 |

OTHER PUBLICATIONS

International Searching Authority, International Search Report and Written Opinion, PCT/US2016/068969, dated Apr. 18, 2017, 10 pages.

* cited by examiner

TOP SIDE BEAM OF CONTAINER AND CONTAINER

CROSS-REFERENCE TO RELATED APPLICATIONS

This application is a 371 U.S. National Phase Entry Application of PCT/US2016/068969, filed Dec. 28, 2016, which claims priority to Chinese Utility Model Application No. 201521117324.X, filed Dec. 29, 2015, now granted as Chinese Utility Model No. CN205274303U, each of which is incorporated herein by reference as if set forth in its entirety.

TECHNICAL FIELD

The utility model relates to components and parts of a container, and in particular, to a support member of a container.

BACKGROUND ART

In the 1960s, the container has developed into a multimodal transport and international universal means of transportation, and the container refers to a large loading vessel which has certain strength, stiffness and specifications specifically for use in turnover. When the container is used to transport goods, the goods may be loaded directly in a shipper's warehouse and then transported to a consignee's warehouse for unloading, and it is unnecessary to take out and reload the goods from the container when a vehicle or ship is changed midway. A simple container has a unified specification, and its structural design has an advantage both in the assembly speed per production unit and the production cost. An international commonly used container is enclosed by a bottom side beam, a bottom beam, a corner column, a corner fitting and a top side beam to form a frame, and sheet materials are mounted on surfaces where the frame is located to form the container body. FIG. 1 partially shows a local structure of the existing container. FIG. 2 shows a structure of a top side beam in a container in a sectional state. As shown in FIG. 1 and FIG. 2, the top side beam 90 is one of the important components of the container 9, and a 60*60 mm square-tube top side beam structure is generally adopted in the prior art, wherein a first surface 91 of the square-tube top side beam 90 is connected to a top plate 93, and a second surface 92 of the square-tube top side beam is connected to a side plate 94; in this way, the top plate 93 and the side plate 94 are connected together through the square-tube top side beam 90.

However, during actual use, the square-tube top side beam structure has some disadvantages, for example, during actual transportation of a container loaded through a semi-trailer, as the top side beam of the container has a relatively small distance in a height direction, the top side beam can only play a role of supporting the top plate of the container; once the container is subject to a greater external impact, the top side beam can hardly play a role of protection, and the side plate near the top side beam is easily punctured by other containers; in some more serious situations, the goods in the container may also be damaged because the container is punctured, so that the container cannot be used normally, thereby reducing the overall use efficiency of the container.

In view of this, transportation enterprises expect that the protection function of the top side beam is improved through improvement on the top side beam so as to enhance the overall security of the container, which thus ensures transportation security of the goods in the container.

SUMMARY OF THE UTILITY MODEL

An object of the utility model is to provide a top side beam of a container. The top side beam of the container has a protection capability, can effectively reduce adverse impacts of an external force on the top side beam and a side plate near the top side beam to prevent the container from being damaged by an external impact and then improve the overall strength of the container, thereby avoiding that the container body is punctured and ensuring integrity and security of goods in the container. In addition, the top side beam of the container according to the utility model has a simple structure, is easy to manufacture, and facilitates convenient modification of the container.

In order to achieve the above object, the utility model provides a top side beam of a container, which has a web plate that extends vertically along a height direction of the container, to increase a vertical height of the top side beam to above 100 mm.

Different from the tube-type top side beam in the prior art, the top side beam of the utility model is provided with a web plate that extends vertically along the height direction of the container, and thus the top side beam has a greater size in the height direction of the container. That is to say, the side plate part originally disposed adjacent to the top side beam in the side plate of the container is replaced with the web plate of the top side beam that extends vertically in the height direction of the container; in this way, once subject to an enormous external force, the top side beam can play a better protection role, so as to avoid that the side plate of the container is punctured.

In the above technical solution, if the vertical height of the top side beam cannot reach more than 100 mm, the top side beam can play a small protection role of resisting the external force; to this end, it is necessary to maintain the vertical height of the top side beam more than 100 mm, so as to provide favorable protection measures for the top plate and/or the side plate of the container and the whole container.

Based on the technical solution of the utility model, there are no strict restrictions on the shape of the web plate and its own structure, which may be set according to actual production and manufacturing demands, as long as the top side beam having the web plate can adapt to the structure of the container.

Further, in the top side beam of the container according to the utility model, the vertical height of the top side beam is increased to 150-400 mm.

In terms of the top side beam of the container according to the utility model, if the vertical height of the top side beam is too small, it is impossible to provide favorable protection for the container; if the vertical height of the top side beam is too great, on one hand, it will affect structural settings of the side plate and the top plate connected to the top side beam, and on the other hand, it will increase material investment of the top side beam and increase the production and manufacturing difficulty of the top side beam. To this end, the vertical height of the top side beam is set between 150-400 mm, which can ensure the protection function of the top side beam without appreciably affecting the structure or weight of the container and increasing the production and manufacturing cost of the top side beam. A skilled artisan in possession of the invention will appreciate that a further increase in vertical height will further increase the weight and cost of the beam and the container, and that these considerations should be balanced against the desire for a top side beam in accord with the invention that provides acceptable impact protection.

Further, the top side beam of the container according to the utility model includes a top side beam body and the web plate fixedly connected to a side of the top side beam body, the web plate being used to shelter or protect an upper edge of the side plate of the container.

Based on the above technical solution, in one implementation, the top side beam body and the web plate fixedly connected therewith are integrally formed, that is to say, there is no connecting gap between the top side beam body and the web plate; in another implementation, the top side beam body and the web plate fixedly connected therewith are not integrally formed, that is to say, a fixed connection between the top side beam body and the web plate may be achieved through an existing connection manner, for example, welding or the top side beam body and the web plate may be connected through a bolt assembly.

Further, the top side beam of the container according to the utility model includes: an upper wing plate, a lower wing plate and a vertical plate which is connected between the upper wing plate and the lower wing plate as the web plate.

Based on the above technical solution, the upper wing plate is connected to a top plate of the container, and the lower wing plate is connected to a side plate of the container. Compared with the top plate or the side plate of the container, the vertical plate connected between the upper wing plate and the lower wing plate has a higher strength and a higher capability of resisting an external impact force. Furthermore, a vertical section of the top side beam is C-shaped or Z-shaped or S-shaped or I-shaped or rectangular. The wing plate can be formed of one or more metals or other force-resistant materials, and can be, for example, a steel plate.

Based on the technical solution of the utility model, the vertical section of the top side beam may be diverse. Herein, the top side beam of which the vertical section is C-shaped includes "C"-shaped (that is, normal C-shaped) top side beam opening towards right and also includes "Ɔ"-shaped (that is, inverted C-shaped) top side beam opening towards left, and the normal C-shaped top side beam and the inverted C-shaped top side beam have mirror symmetry therebetween. Similarly, the Z-shaped top side beam also includes "Z"-shaped (that is, normal Z shape) top side beam and "Ƶ"-shaped (that is, inverted Z shape) top side beam; and the S-shaped top side beam also includes "S"-shaped (that is, normal S-shaped) top side beam and "Ƨ"-shaped (that is, inverted S-shape) top side beam.

It should be noted that, although the vertical plate or a partial structure of the vertical plate in the Z-shaped top side beam or the S-shaped top side beam is disposed obliquely, it also belongs to the "vertical plate" defined in the technical solution of the utility model.

In some implementations, when the vertical section of the top side beam is C-shaped or Z-shaped or S-shaped or I-shaped, the upper wing plate and/or the lower wing plate have/has a flange extending downwards or provided with a rolled (not sharp) edge that can further avoid impact damage to the container or its cargo.

Based on the above technical solution, the top side beam of which the vertical section is C-shaped includes a top side beam in a normal C shape and a top side beam in an inverted C shape; the top side beam of which the vertical section is Z-shaped includes a top side beam in a normal Z shape and a top side beam in an inverted Z shape; and the top side beam of which the vertical section is S-shaped includes a top side beam in a normal S shape and a top side beam in an inverted S shape.

A flange extending downwards is disposed on the upper wing plate or the lower wing plate or on both of them, with the purpose of further improving the strength of the upper wing plate and/or the lower wing plate, and at the same time, reducing adverse deformation that may occur when the top side beam is welded with the top plate of the container and/or the side plate of the container and reducing the welding difficulty.

Compared with a flange extending upwards, the upper wing plate and/or the lower wing plate being provided with a flange extending downwards may not affect drainage of the container while enhancing the strength of the upper and lower wing plates, which favorably avoids ponding of the container at the top side beam.

In some other implementations, when the vertical section of the top side beam is C-shaped or Z-shaped or S-shaped or I-shaped, a support plate is further provided between a free end of the upper wing plate and/or the lower wing plate and the vertical plate.

Based on the above technical solution, the top side beam of which the vertical section is C-shaped includes a top side beam in a normal C shape and a top side beam in an inverted C shape; the top side beam of which the vertical section is Z-shaped includes a top side beam in a normal Z shape and a top side beam in an inverted Z shape; and the top side beam of which the vertical section is S-shaped includes a top side beam in a normal S shape and a top side beam in an inverted S shape.

Herein, the free end of the upper wing plate refers to the end on the upper wing plate which is away from the vertical plate, and the free end of the lower wing plate refers to the end on the lower wing plate which is away from the vertical plate.

A support plate being disposed between the free end of the upper wing plate and the vertical plate is to improve the strength of the upper wing plate, reduce adverse deformation that may occur when the top side beam is welded with the top plate of the container and reduce the welding difficulty. Similarly, a support plate being disposed between the free end of the lower wing plate and the vertical plate is to improve the strength of the lower wing plate, reduce adverse deformation that may occur when the top side beam is welded with the side plate of the container and reduce the welding difficulty.

Based on the above implementation, under one circumstance, a support plate independent of the free end of the upper wing plate and/or the lower wing plate and the vertical plate is connected between them, that is to say, the support plate may achieve a fixed connection between it and the free end of the upper wing plate and/or the lower wing plate as well as the vertical plate through an existing connection manner (for example, welding) respectively. Under another circumstance, the free end of the upper wing plate and/or the lower wing plate and the support plate are integrally formed, that is to say, the support plate is formed by directly extending the free end of the upper wing plate and/or the lower wing plate to the vertical plate.

Furthermore, in the top side beam of the container according to the utility model, a stiffener protruding beyond a plate surface of the web plate is provided on the web plate.

As the probability that the web plate directly comes into contact with the external impact is the highest and the web plate is the easiest to deform and recess, disposing a stiffener protruding beyond a plate surface thereof on the web plate is for the purpose of improving the strength of the web plate and enhancing the resistance of the web plate to the external force.

Herein, the shape and structure of the stiffener may be diversified, for example, it may be a stiffener of which the vertical section is rectangular, may be a stiffener of which the vertical section is trapezoidal, and may also be a stiffener of which the vertical section is semicircular, or a stiffener of which the vertical section is triangular.

Similarly, the number of the stiffener is not strictly specified, which may be one or more.

Furthermore, the top side beam includes at least a first part and a second part vertically superposed in an order from top to bottom, wherein shapes of vertical sections of the first part and the second part are selected from at least one of C shape, Z shape, S shape, I shape and rectangular shape; and the vertical plate includes at least a vertical plate of the first part and a vertical plate of the second part.

Based on the above technical solution, the top side beam of which the vertical section is C-shaped includes a top side beam in a normal C shape and a top side beam in an inverted C shape; the top side beam of which the vertical section is Z-shaped includes a top side beam in a normal Z shape and a top side beam in an inverted Z shape; and the top side beam of which the vertical section is S-shaped includes a top side beam in a normal S shape and a top side beam in an inverted S shape.

In the above technical solution, the top side beam may also be obtained through pairwise superposition, and thus the vertical plate of the top side beam is made up of vertical plates superposed and combined, to further improve the protection capability of the top side beam and enhance the overall strength of the container.

In addition, the vertical height of the top side beam may be increased through superposition on the basis of the original top side beam, avoiding abandonment of the existing top side beam.

In addition, full use of different types of top side beams is also achieved through superposition, which has good flexibility and strong convenience.

Certainly, the number of the superposition part in the top side beam is not strictly restricted, which may be set according to actual production and manufacturing demands, as long as the top side beam obtained through superposition may not affect the structure of the container, for example, the top side beam may include a first part, a second part and a third part vertically superposed in an order from top to bottom.

Furthermore, an upper wing plate formed on the first part of which the vertical section is C-shaped or Z-shaped or S-shaped or I-shaped and/or a lower wing plate formed on the second part of which the vertical section is C-shaped or Z-shaped or S-shaped or I-shaped have/has a flange extending downwards.

Based on the above technical solution, the top side beam of which the vertical section is C-shaped includes a top side beam in a normal C shape and a top side beam in an inverted C shape; the top side beam of which the vertical section is Z-shaped includes a top side beam in a normal Z shape and a top side beam in an inverted Z shape; and the top side beam of which the vertical section is S-shaped includes a top side beam in a normal S shape and a top side beam in an inverted S shape.

When the first part and/or the second part adopt/adopts a structure of which the vertical section is C-shaped or Z-shaped or S-shaped or I-shaped, an upper wing plate of the first part and/or a lower wing plate of the second part are/is provided with a flange extending downwards to further improve the strength of the first part and/or the second part, which thus improves the strength of the top side beam, reduces adverse deformation that may occur when the top side beam is welded with the top plate of the container and/or the side plate of the container and reduces the welding difficulty.

Compared with a flange extending upwards, the upper wing plate of the first part and/or the lower wing plate of the second part being provided with a flange extending downwards may not affect drainage of the container while enhancing the strength of the upper and lower wing plates, which favorably avoids ponding of the container at the top side beam.

Furthermore, the vertical plate of the first part of which the vertical section is C-shaped or Z-shaped or S-shaped or I-shaped and/or the vertical plate of the second part of which the vertical section is C-shaped or Z-shaped or S-shaped or I-shaped have/has a stiffener protruding beyond its own plate surface.

Based on the above technical solution, the top side beam of which the vertical section is C-shaped includes a top side beam in a normal C shape and a top side beam in an inverted C shape; the top side beam of which the vertical section is Z-shaped includes a top side beam in a normal Z shape and a top side beam in an inverted Z shape; and the top side beam of which the vertical section is S-shaped includes a top side beam in a normal S shape and a top side beam in an inverted S shape.

It should be noted that the stiffener may adopt different types of structure or shape, for example, it may be a stiffener of which the vertical section is rectangular, may be a stiffener of which the vertical section is trapezoidal, and may also be a stiffener of which the vertical section is semicircular, or a stiffener of which the vertical section is triangular.

Evidently, the structure and/or the number of the stiffeners disposed on the vertical plate of the first part may be the same as or different from the structure and/or the number of the stiffeners disposed on the vertical plate of the second part.

Another object of the utility model is to provide a container, the container has higher strength, especially the top side beam of the container and the side plate connected to the top side beam have high strength, which is not easy to deform under the action of external impact, effectively avoids that the side plate of the container is punctured, favorably ensures the integrity of goods in the container, and reduces the loss ratio of the transported goods.

In order to achieve the above object, the utility model further proposes a container, which has any of the top side beams as mentioned hereinabove.

The top side beam according to the utility model can effectively resist external impact, which has a good protection function.

In addition, the top side beam according to the utility model can favorably reduce adverse impact of the external impact on the top side beam and the side plate connected to the top side beam to prevent the container from being damaged by an external force and then improve the overall strength of the container, thereby avoiding that the container body is punctured and ensuring integrity and security of goods in the container.

In addition, the top side beam of the container according to the utility model has a simple structure, is easy to manufacture, and facilitates convenient modification of the container.

At the same time, the top side beam of the container according to the utility model has a long service life, an economic production cost and an extensive application range.

The container according to the utility model has high strength, great capability of resisting external impact, good protection performance, a long service life and an economic maintenance cost.

In addition, the container according to the utility model is especially suitable for transportation of freight on semi-trailers.

DETAILED DESCRIPTION

The top side beam of the container and the container according to the utility model are further described below with reference to the accompanying drawings of the specification and specific implementations, but the description does not constitute improper limitations to the technical solution of the utility model.

Figure 1:
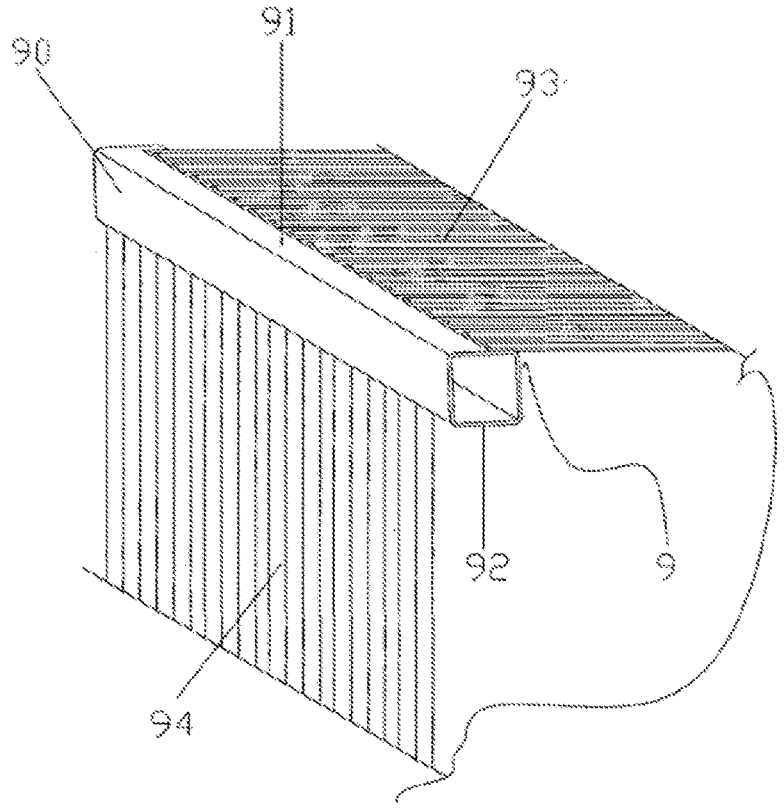
FIG. 1 partially shows a schematic diagram of a partial structure of the existing container.
Figure 2:
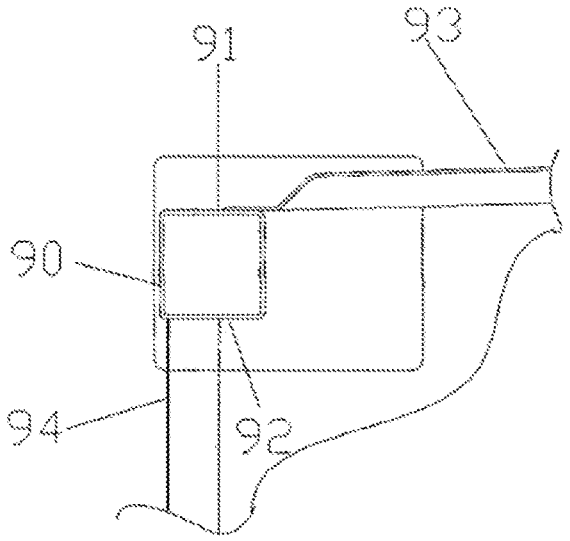
FIG. 2 is a schematic structural diagram of a top side beam in a container in a sectional state.
Figure 3:
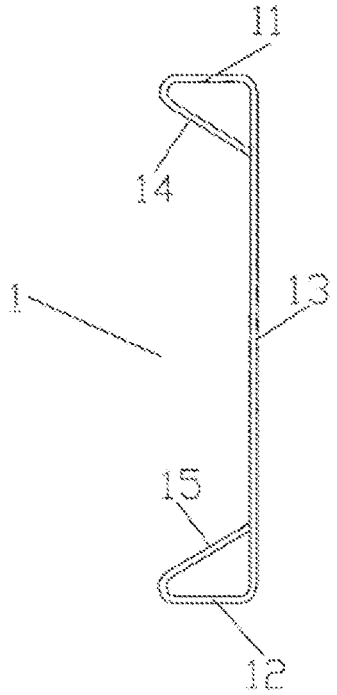
FIG. 3 is a schematic structural diagram of a top side beam of a container according to the utility model in a first implementation.
Figure 4:
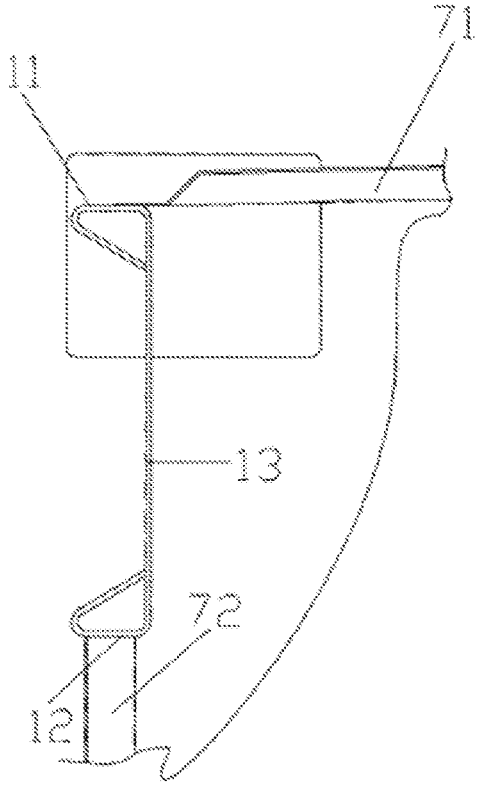
FIG. 4 is a schematic structural diagram of the top side beam shown in FIG. 3 in a mounting state.

FIG. 3 shows a structure of the top side beam of the container according to the utility model in a first implementation. FIG. 4 shows a structure of the top side beam in a mounting state.

As shown in FIG. 3 and FIG. 4, in the implementation, the top side beam 1 has a web plate that extends vertically along a height direction of the container, to increase a vertical height of the top side beam to above 100 mm, wherein the top side beam 1 includes an upper wing plate 11, a lower wing plate 12 and a vertical plate 13 which is connected between the upper wing plate 11 and the lower wing plate 12 as the web plate, a vertical section of the top side beam 1 is in an inverted C shape, and an opening of the top side beam in the inverted C shape is outside the container body. A support plate 14 is provided between a free end of the upper wing plate 11 and the vertical plate 13, and a support plate 15 is provided between a free end of the lower wing plate 12 and the vertical plate 13, for improving the strength of the upper and lower wing plates, reducing adverse deformation that may occur when the top side beam is welded with a top plate 71 and a side plate 72 of the container and reducing the welding difficulty. The support plates 14 and 15 are triangular structures formed by directly extending the free end of the upper wing plate 11 and the free end of the lower wing plate 12 to the vertical plate 13 respectively, that is to say, the upper wing plate 11 and the support plate 14 are integrally formed, and at the same time, the lower wing plate 12 and the support plate 15 are also integrally formed.

As shown in FIG. 4, reference may be made to FIG. 3 if necessary, the free end of the upper wing plate 11 refers to the end on the upper wing plate 11 which is away from the vertical plate 13, and the free end of the lower wing plate 12 refers to the end on the lower wing plate 12 which is away from the vertical plate 13.

Similarly, in the top side beams shown in the following drawings, the free end of the upper wing plate refers to the end on the upper wing plate which is away from the vertical plate, and the free end of the lower wing plate refers to the end on the lower wing plate which is away from the vertical plate.

In other implementations, a support plate independent of the free end of the upper wing plate and/or the lower wing plate and the vertical plate is connected between them, that is to say, the support plate may achieve a fixed connection between it and the free end as well as the vertical plate through an existing connection manner (for example, welding) respectively.

Figure 5:
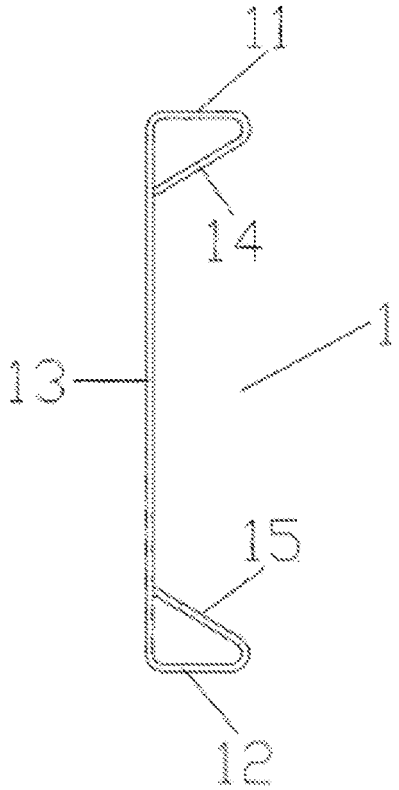
FIG. 5 is a schematic structural diagram of the top side beam of the container according to the utility model in a second implementation.
Figure 6:
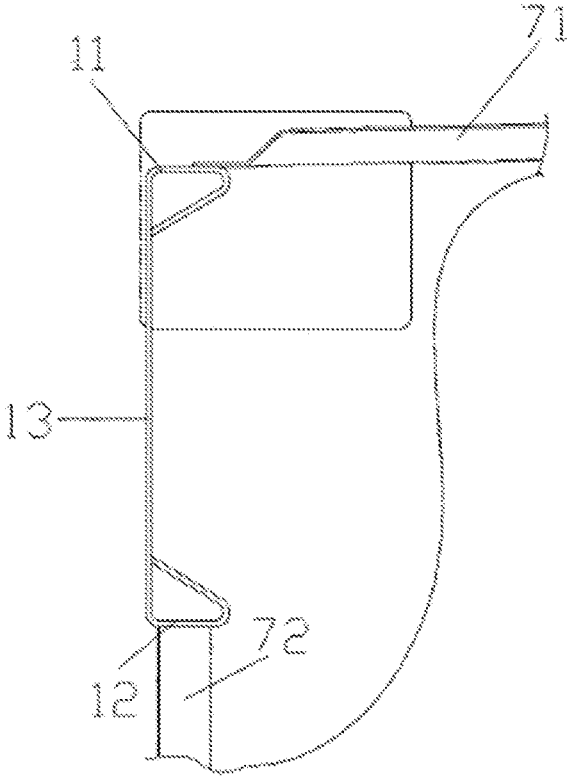
FIG. 6 is a schematic structural diagram of the top side beam shown in FIG. 5 in a mounting state.

FIG. 5 shows a structure of the top side beam of the container according to the utility model in a second implementation. FIG. 6 shows a structure of the top side beam in a mounting state.

As shown in FIG. 5 and FIG. 6, the structure of the top side beam 1 in the implementation is similar to that of the top side beam in the first implementation, and their difference lies in that: the vertical section of the top side beam 1 is in a normal C shape. In this case, an opening of the top side beam 1 in the normal C shape is inside the container body.

Figure 7:
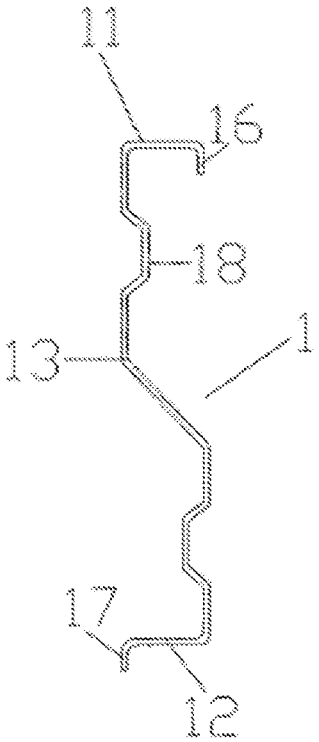
FIG. 7 is a schematic structural diagram of the top side beam of the container according to the utility model in a third implementation.
Figure 8:
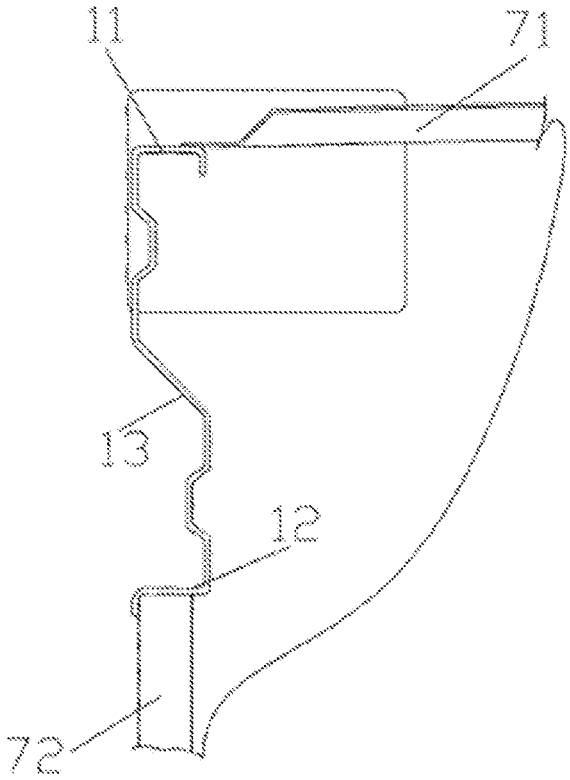
FIG. 8 is a schematic structural diagram of the top side beam shown in FIG. 7 in a mounting state.

FIG. 7 shows a structure of the top side beam of the container according to the utility model in a third implementation. FIG. 8 shows a structure of the top side beam in a mounting state.

As shown in FIG. 7 and FIG. 8, in the implementation, the top side beam 1 has a web plate that extends vertically along a height direction of the container, to increase a vertical height of the top side beam to above 100 mm, wherein the top side beam 1 includes an upper wing plate 11, a lower wing plate 12 and a vertical plate 13 which is connected between the upper wing plate 11 and the lower wing plate 12 as the web plate, a vertical section of the top side beam is in a normal S shape, the upper wing plate 11 is fixedly connected to a top plate 71 of the container, and the lower wing plate 12 is fixedly connected to a side plate 72 of the container. A stiffener 18 protruding beyond a plate surface of the web plate is provided on the web plate, and a vertical section of the stiffener 18 is trapezoidal. Flanges 16 and 17 extending downwards are further disposed on the upper wing plate 11 and the lower wing plate 12 respectively, for improving the strength of the upper and lower wing plates, reducing adverse deformation that may occur when the top side beam is welded with the top plate 71 and the side plate 72 of the container and reducing the welding difficulty. The flanges 16 and 17 are formed by directly bending the upper wing plate 11 and the lower wing plate 12 downwards respectively, that is to say, the upper wing plate 11 and the flange 16 are integrally formed, and the lower wing plate 12 and the flange 17 are also integrally formed.

Compared with a flange extending upwards, the flange extending downwards may not affect drainage of the container while enhancing the strength of the upper and lower wing plates, which favorably avoids ponding of the container at the top side beam.

In another implementation, the vertical section of the top side beam may also be in an inverted S shape.

Figure 9:
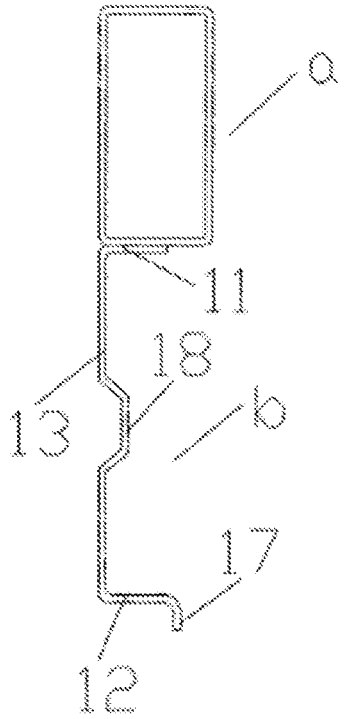
FIG. 9 is a schematic structural diagram of the top side beam of the container according to the utility model in a fourth implementation.
Figure 10:
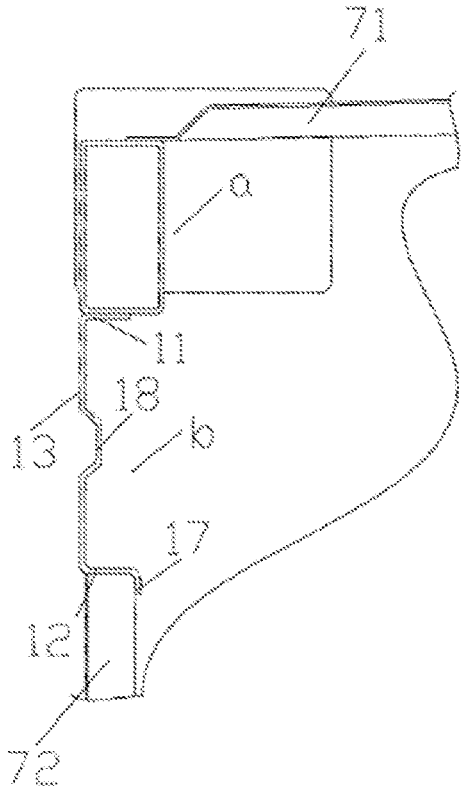
FIG. 10 is a schematic structural diagram of the top side beam shown in FIG. 9 in a mounting state.

FIG. 9 shows a structure of the top side beam of the container according to the utility model in a fourth implementation. FIG. 10 shows a structure of the top side beam in a mounting state.

As shown in FIG. 9 and FIG. 10, in the implementation, the top side beam 1 includes a first part a and a second part b vertically superposed in an order from top to bottom, wherein a vertical section of the first part a is rectangular, a vertical section of the second part b is in a normal C shape, and the vertical plate of the whole top side beam includes a vertical plate of the first part a and a vertical plate of the second part b. An upper wing plate of the first part a is connected to a top plate 71 of the container. The second part b includes: an upper wing plate 11, a lower wing plate 12 and a vertical plate 13 which is connected between the upper wing plate 11 and the lower wing plate 12, and the lower wing plate 12 of the second part b is fixedly connected to a side plate 72 of the container. A stiffener 18 protruding beyond a plate surface of the web plate is provided on the web plate, and a vertical section of the stiffener 18 is trapezoidal, wherein the lower wing plate 12 has a flange 17 extending downwards, so as to improve the strength of the lower wing plate, reduce adverse deformation that may occur when the top side beam 1 is welded with the side plate 72 of the container and reduce the welding difficulty. The flange 17 is formed by directly bending the lower wing plate 12 downwards, that is to say, the lower wing plate 12 and the flange 17 are integrally formed.

Figure 11:
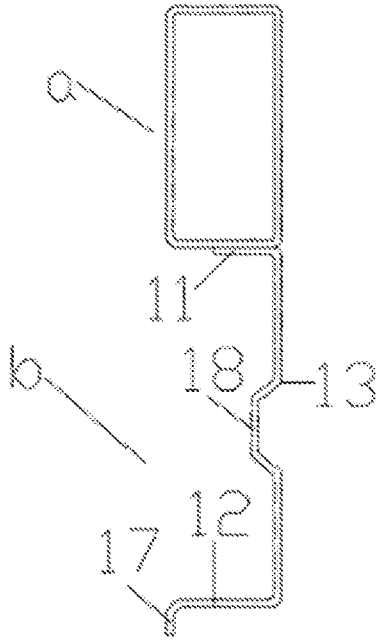
FIG. 11 is a schematic structural diagram of the top side beam of the container according to the utility model in a fifth implementation.
Figure 12:
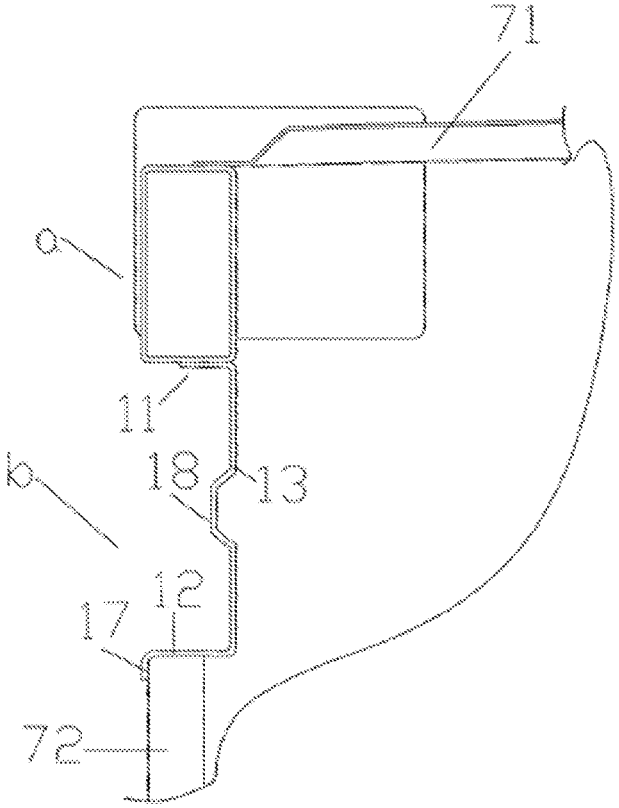
FIG. 12 is a schematic structural diagram of the top side beam shown in FIG. 11 in a mounting state.

FIG. 11 shows a structure of the top side beam of the container according to the utility model in a fifth implementation. FIG. 12 shows a structure of the top side beam in a mounting state.

As shown in FIG. 11 and FIG. 12, the structure of the top side beam in the implementation is similar to that of the top side beam in the fourth implementation, and their difference lies in that: the vertical section of the second part b in the top side beam is in an inverted C shape.

FIG. 13 to FIG. 34 show structures of the top side beam of the container according to the utility model in different implementations.

Figure 13:
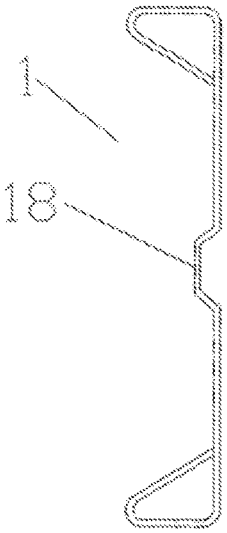
FIG. 13 to FIG. 34 are schematic structural diagrams of the top side beam of the container according to the utility model in different implementations.

As shown in FIG. 3 and FIG. 13, the structure of the top side beam 1 in a sixth implementation is similar to that of the top side beam in the first implementation, and their difference lies in that: a stiffener 18 protruding beyond a plate surface of the web plate is provided on the web plate of the top side beam 1, and a vertical section of the stiffener 18 is trapezoidal.

Figure 14:
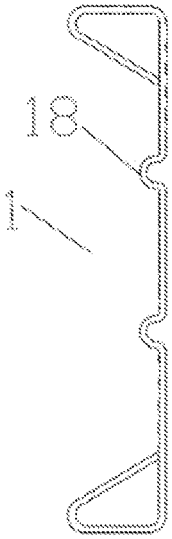

As shown in FIG. 3 and FIG. 14, the structure of the top side beam 1 in a seventh implementation is similar to that of the top side beam in the first implementation, and their difference lies in that: a pair of stiffeners 18 protruding beyond a plate surface of the web plate are provided on the web plate of the top side beam 1, and vertical sections of the pair of stiffeners 18 are both semicircular.

Figure 15:
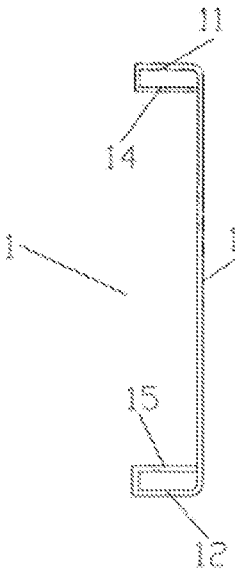

As shown in FIG. 3 and FIG. 15, the structure of the top side beam 1 in an eighth implementation is similar to that of the top side beam in the first implementation, and their difference lies in that: the support plates 14 and 15 are quadrangular structures formed by directly extending the free end of the upper wing plate 11 and the free end of the lower wing plate 12 to the vertical plate 13 respectively.

Figure 16:
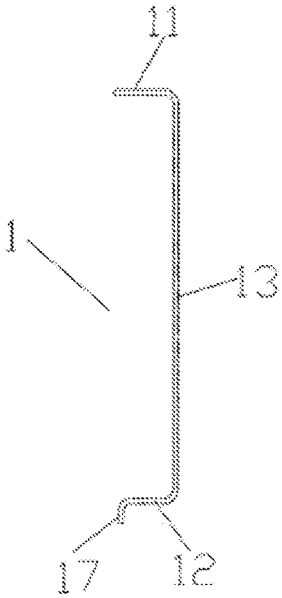

As shown in FIG. 3 and FIG. 16, the structure of the top side beam 1 in a ninth implementation is similar to that of the top side beam in the first implementation, and their difference lies in that: there are no support plates between the free end of the upper wing plate 11 as well as the free end of the lower wing plate 12 and the vertical plate 13, but the lower wing plate 12 has a flange 17 extending downwards.

Figure 17:
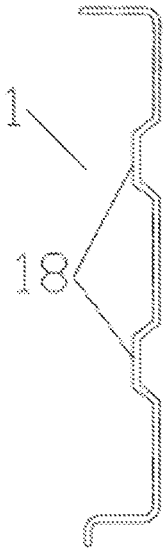

As shown in FIG. 16 and FIG. 17, the structure of the top side beam 1 in a tenth implementation is similar to that of the top side beam in the ninth implementation, and their difference lies in that: a pair of stiffeners 18 protruding beyond a plate surface of the web plate are provided on the web plate of the top side beam 1, and vertical sections of the pair of stiffeners 18 are both trapezoidal.

Figure 18:
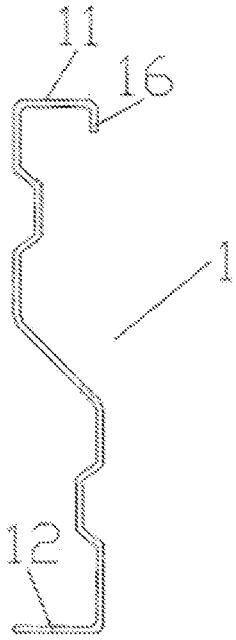

As shown in FIG. 7 and FIG. 18, the structure of the top side beam 1 in an eleventh implementation is similar to that of the top side beam in the third implementation, and their difference lies in that: although the upper wing plate 11 of the top side beam 1 has a flange 16 extending downwards, the lower wing plate 12 does not have a flange extending downwards.

Figure 19:
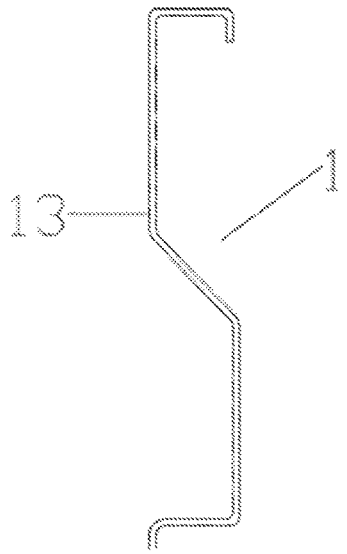

As shown in FIG. 7 and FIG. 19, the structure of the top side beam 1 in a twelfth implementation is similar to that of the top side beam in the third implementation, and their difference lies in that: no stiffener protruding beyond a plate surface of the web plate is disposed on the vertical plate 13 of the top side beam 1.

Figure 20:
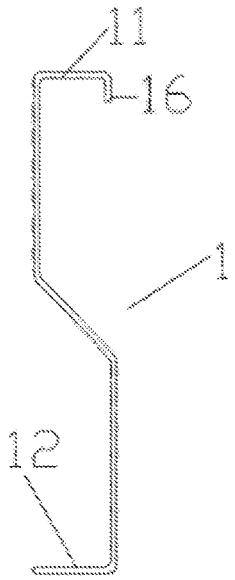

As shown in FIG. 19 and FIG. 20, the structure of the top side beam 1 in a thirteenth implementation is similar to that of the top side beam in the twelfth implementation, and their difference lies in that: although the upper wing plate of the top side beam 1 has a flange 16 extending downwards, the lower wing plate 12 is not provided with a flange extending downwards.

Figure 21:
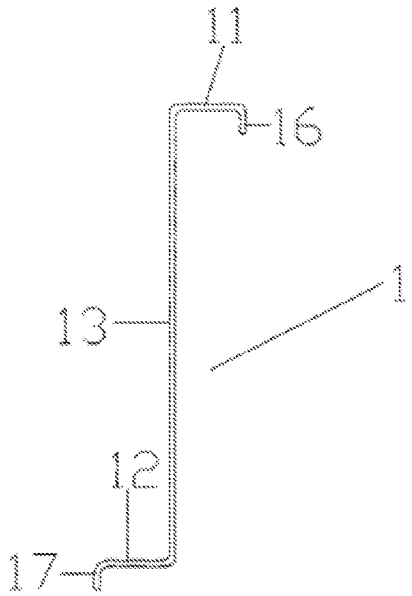

As shown in FIG. 21, in a fourteenth implementation, the top side beam 1 has a web plate that extends vertically along a height direction of the container, wherein the top side beam 1 includes an upper wing plate 11, a lower wing plate 12 and a vertical plate 13 which is connected between the upper wing plate 11 and the lower wing plate 12 as the web plate, and a vertical section of the top side beam is in an inverted Z shape. The upper wing plate 11 and the lower wing plate 12 further have flanges 16 and 17 extending downwards respectively, to improve the strength of the upper and lower wing plates, reduce adverse deformation that may occur when the top side beam is welded with the top plate and the side plate of the container and reduce the welding difficulty. The flanges 16 and 17 are formed by directly bending the upper wing plate 11 and the lower wing plate 12 downwards respectively, that is to say, the upper wing plate 11 and the flange 16 are integrally formed, and the lower wing plate 12 and the flange 17 are also integrally formed.

In other implementations, the vertical section of the top side beam may also be in a normal Z shape.

Figure 22:
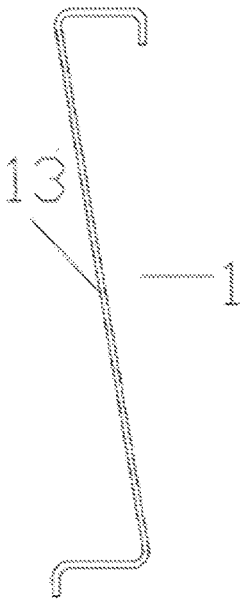

As shown in FIG. 21 and FIG. 22, the structure of the top side beam 1 in a fifteenth implementation is similar to that of the top side beam in the fourteenth implementation, and their difference lies in that: the vertical plate 13 in the top side beam 1 is disposed obliquely.

Figure 23:
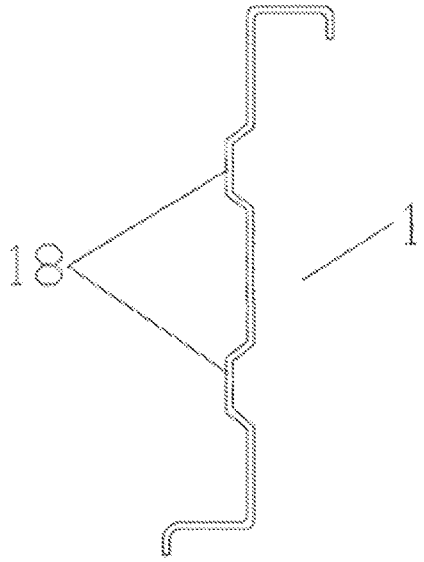

As shown in FIG. 21 and FIG. 23, the structure of the top side beam 1 in a sixteenth implementation is similar to that of the top side beam in the fourteenth implementation, and their difference lies in that: a pair of stiffeners 18 protruding beyond a plate surface of the web plate are provided on the web plate of the top side beam 1, and vertical sections of the pair of stiffeners 18 are both trapezoidal.

Figure 24:
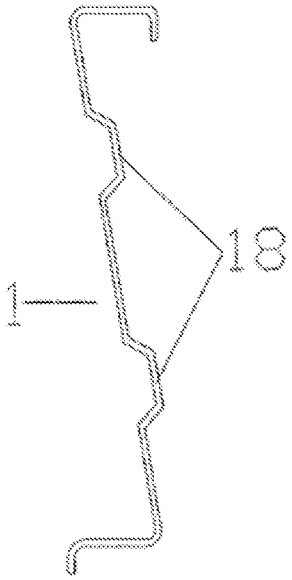

As shown in FIG. 22 and FIG. 24, the structure of the top side beam 1 in a seventeenth implementation is similar to that of the top side beam in the fifteenth implementation, and their difference lies in that: a pair of stiffeners 18 protruding beyond a plate surface of the web plate are provided on the web plate of the top side beam 1, and vertical sections of the pair of stiffeners 18 are both trapezoidal.

Figure 25:
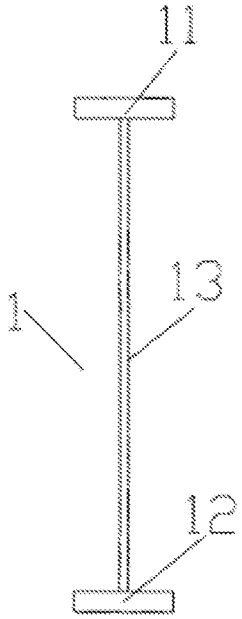

As shown in FIG. 25, in an eighteenth implementation, the top side beam 1 has a web plate that extends vertically along a height direction of the container, wherein the top side beam 1 includes an upper wing plate 11, a lower wing plate 12 and a vertical plate 13 which is connected between the upper wing plate 11 and the lower wing plate 12 as the web plate, and a vertical section of the top side beam 1 is I-shaped.

Figure 26:
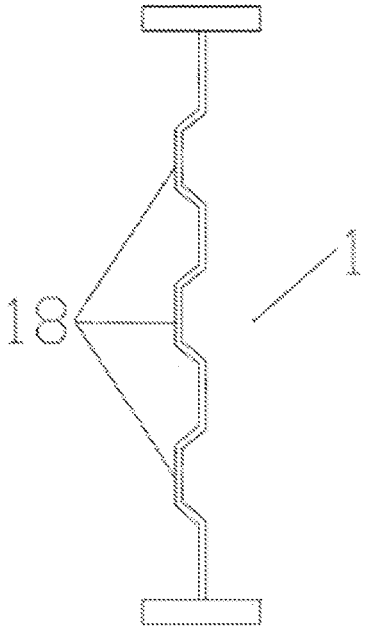

As shown in FIG. 25 and FIG. 26, the structure of the top side beam 1 in a nineteenth implementation is similar to that of the top side beam in the eighteenth implementation, and their difference lies in that: several stiffeners 18 protruding beyond a plate surface of the web plate are provided on the web plate of the top side beam 1, and vertical sections of the stiffeners 18 are all trapezoidal.

Figure 27:
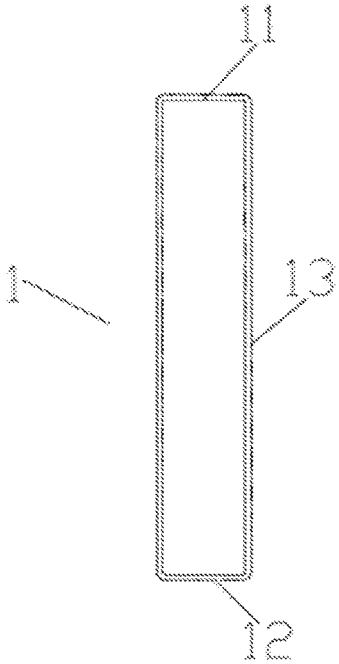

In addition, as shown in FIG. 27, in a twentieth implementation, the top side beam 1 has a web plate that extends vertically along a height direction of the container, wherein the top side beam 1 includes an upper wing plate 11, a lower wing plate 12 and a vertical plate 13 which is connected between the upper wing plate 11 and the lower wing plate 12 as the web plate, and a vertical section of the top side beam 1 is rectangular.

Figure 28:
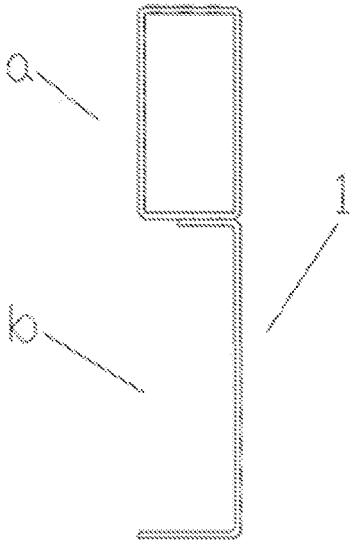

As shown in FIG. 28, in a twenty-first implementation, the top side beam 1 includes a first part a and a second part b vertically superposed in an order from top to bottom, wherein a vertical section of the first part a is rectangular, a vertical section of the second part b is in an inverted C shape, and the vertical plate of the whole top side beam 1 includes a vertical plate of the first part a and a vertical plate of the second part b.

Figure 29:
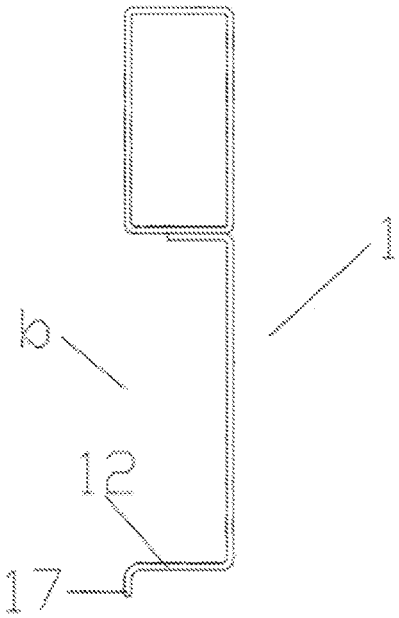

As shown in FIG. 28 and FIG. 29, the structure of the top side beam 1 in a twenty-second implementation is similar to that of the top side beam in the twenty-first implementation, and their difference lies in that: the lower wing plate 12 of the second part b in the top side beam 1 is provided with a flange 17 extending downwards.

Figure 30:
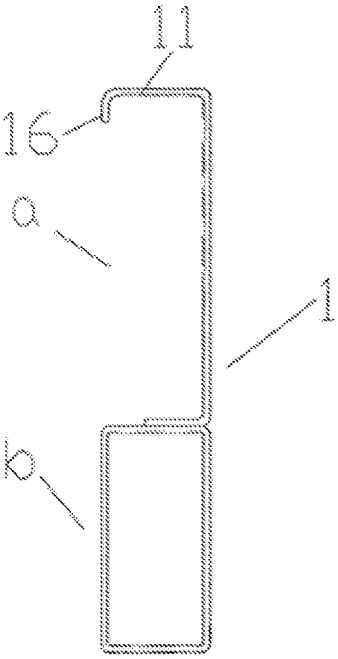

As shown in FIG. 30, in a twenty-third implementation, the top side beam 1 includes a first part a and a second part b vertically superposed in an order from top to bottom, wherein a vertical section of the first part a is in an inverted C shape, a vertical section of the second part b is rectangular, and the vertical plate of the whole top side beam 1 includes a vertical plate of the first part a and a vertical plate of the second part b. The upper wing plate 11 of the first part a in the top side beam has a flange 16 extending downwards.

Figure 31:
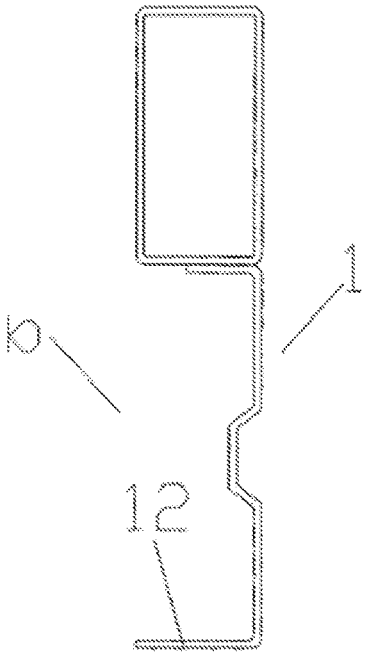

As shown in FIG. 11 and FIG. 31, the structure of the top side beam 1 in a twenty-fourth implementation is similar to that of the top side beam in the fifth implementation, and their difference lies in that: the lower wing plate 12 of the second part b in the top side beam 1 is not provided with a flange extending downwards.

Figure 32:
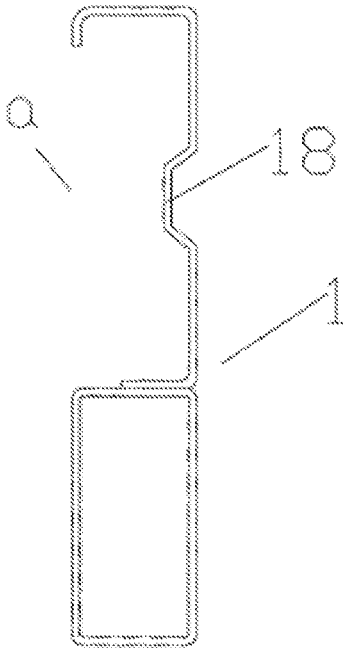

As shown in FIG. 30 and FIG. 32, the structure of the top side beam 1 in a twenty-fifth implementation is similar to that of the top side beam in the twenty-third implementation, and their difference lies in that: a stiffener 18 protruding beyond a plate surface of the web plate is provided on the web plate of the first part a in the top side beam 1, and a vertical section of the stiffener 18 is trapezoidal.

Figure 33:
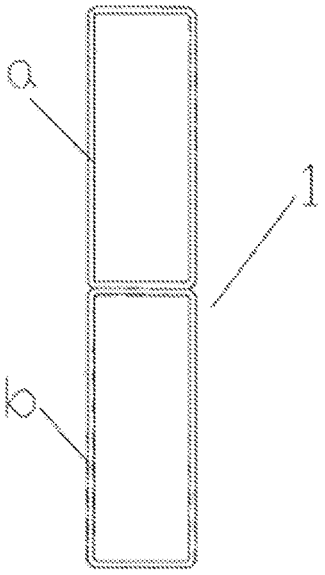

As shown in FIG. 33, in a twenty-sixth implementation, the top side beam 1 includes a first part a and a second part b vertically superposed in an order from top to bottom, wherein vertical sections of the first part a and the second part b are both rectangular, and the first part a and the second part b have the same size.

Figure 34:
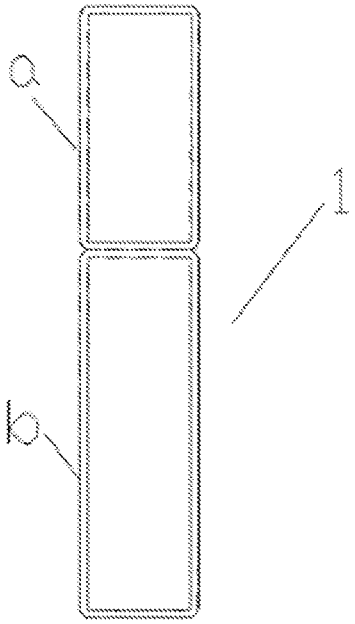

As shown in FIG. 33 and FIG. 34, the structure of the top side beam 1 in a twenty-seventh implementation is similar to that of the top side beam in the twenty-sixth implementation, and their difference lies in that: the area of the vertical section of the first part a in the top side beam 1 is less than that of the vertical section of the second part b.

Evidently, based on the technical solution of the utility model, the first part and the second part vertically superposed in an order from top to bottom may be diversified, and the first part and the second part may be freely combined and superposed. At the same time, when the vertical section of the first part is C-shaped or Z-shaped or S-shaped or I-shaped, the upper wing plate of the first part may be provided with a flange extending downwards. Similarly, when the vertical section of the first part is C-shaped or Z-shaped or S-shaped or I-shaped, the lower wing plate of the second part may be provided with a flange extending downwards.

Based on the above different implementations, more preferably, the vertical height of the top side beam is 150-400 mm.

In an implementation of the top side beam 1 of which all sides are open, all the open parts may serve as a storage space, used to place various electronic devices (for example, GPS locators and/or electronic trackers) in a concealed way, for the owner of the container, the shipper or the consignee to query the location of the container or track the loading condition (no load, full load, partial load and so on) of the container, whether the door is opened and closed abnormally and the like.

It should be noted that, except the top side beams shown in FIG. 27, FIG. 33 and FIG. 34, the top side beams 1 shown in other drawings all can place various electronic devices (for example, GPS locators and/or electronic trackers) in a concealed way.

Figure 35:
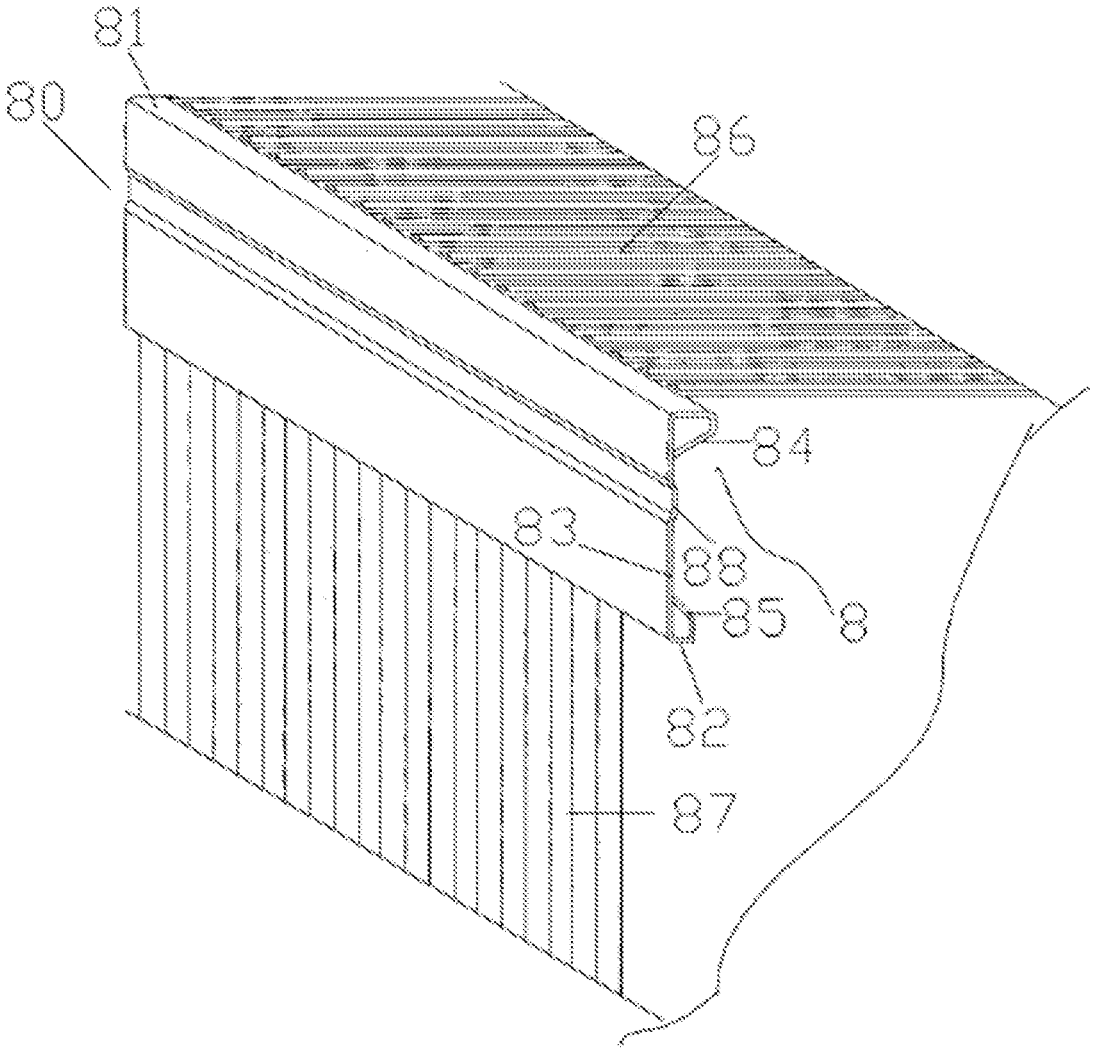
FIG. 35 partially shows a schematic structural diagram of the container according to the utility model in an implementation.

FIG. 35 shows a partial structure of the container according to the utility model in an implementation.

As shown in FIG. 35, the container 8 is enclosed by a bottom side beam, a bottom beam, a corner column, a corner fitting and a top side beam to form a frame, wherein the top side beam 80 includes an upper wing plate 81, a lower wing plate 82 and a vertical plate 83 which is connected between the upper wing plate 81 and the lower wing plate 82 as the web plate, and a vertical section of the top side beam 80 is in a normal C shape. A stiffener 88 protruding beyond a plate surface of the web plate is provided on the web plate, and a vertical section of the stiffener 88 is trapezoidal. A support plate 84 is provided between a free end of the upper wing plate 81 and the vertical plate 83, and a support plate 85 is also provided between a free end of the lower wing plate 82 and the vertical plate 83. The support plates 84 and 85 are triangular structures formed by directly extending the free end of the upper wing plate 81 and the free end of the lower wing plate 82 to the vertical plate 83 respectively. The upper wing plate 81 is fixedly connected to a top plate 86 of the container, and the lower wing plate 82 is fixedly connected to a side plate 87 of the container.

Figure 36:
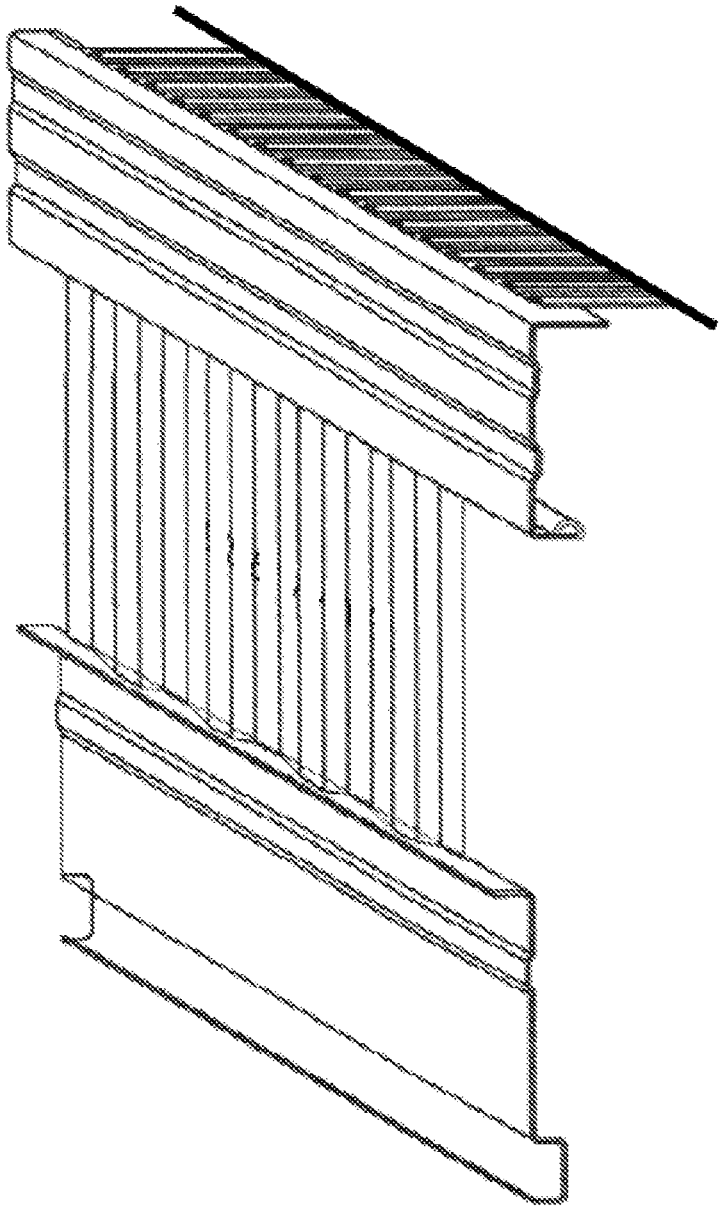
FIG. 36 and FIG. 37 show two schematic views of an additional embodiment of a portion of a container having a top side beam in accord with the invention.
Figure 37:
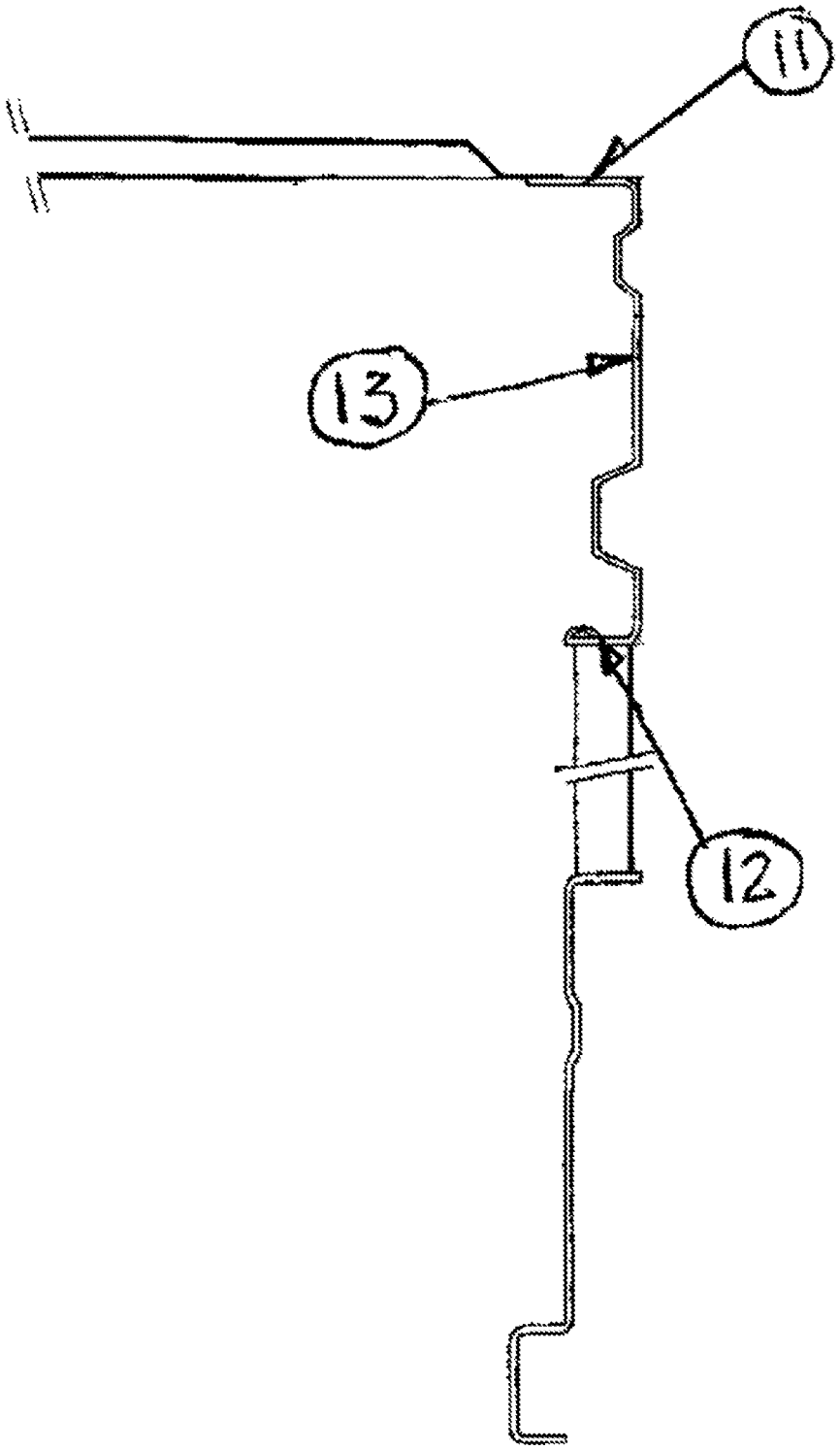

FIG. 36 and FIG. 37 show an embodiment of a container in accord with the invention wherein the top side beam has a web plate that extends vertically along the height direction of the container to increase the vertical height of the top side beam to above 100 mm, wherein the top side beam includes an upper wing plate 11, a lower wing plate 12 and a vertical plate 13 which is connected between the upper wing plate 11 and the lower wing plate 12 forming the top side beam. The vertical plate 13 has longitudinal corrugations that run the full length of the vertical plate to add torsional stiffness and increase the impact resistance of the vertical plate. Moreover, the lower wing plate is rolled back upon itself such that no sharp edge protrudes toward the side plate of the container and risk of impact damage to the side plate or the goods in the container is avoided.

As some other main structures (for example, the bottom side beam, the bottom beam and the like) in the container and the underframe of the container of the utility model are not evidently different from the structure adopted in the prior art, they are not described in detail herein through other specification drawings.

It should be noted that the above description of the embodiments disclosed enables those skilled in the art to obviously make lots of similar changes and modifications to the embodiments, for example by substituting one disclosed aspect of the top side beam for another, or by adjusting the relative dimensions of various aspects of the top side beam. Such similar changes are all transformations that those skilled in the art can directly obtain from the content disclosed in the utility model or easily associate, and all belong to the protection scope of the utility model. Therefore, the utility model may not be limited by the embodiments.

The invention claimed is:

1. A shipping container with a top side beam, the top side beam comprising:

an open-sided beam comprising a web which includes:

a vertical web plate that extends vertically along a height direction of the container, the vertical web plate comprising a stiffener extending a length of the web plate;

a lower wing plate connected to a lower portion of the vertical web plate, a first portion of the lower wing plate being substantially flat and extending perpendicular to the vertical web plate in a horizontal direction towards an inside portion of the container, the lower wing plate further comprising a second portion being connected to the first portion and being rolled back towards the vertical web plate and downward onto the first portion, and the lower wing plate being fixedly connected to a side plate of the container; and an upper wing plate connected to an upper portion of the vertical web plate, the upper wing plate being substantially flat and extending perpendicular to the vertical web plate in a horizontal direction towards the inside portion of the container, and the upper wing plate being fixedly connected to a top plate of the container.

2. The shipping container of claim 1, wherein the upper wing plate extends further towards the inside portion of the container than the lower wing plate.

3. The shipping container of claim 1, wherein the stiffener is a first stiffener, and wherein the vertical web plate further comprises a second stiffener offset from the first stiffener and which extends the length of the web plate.

4. The shipping container of claim 3, wherein at least one of the first stiffener and the second stiffener has a trapezoidal cross-sectional shape.

5. The shipping container of claim 3, wherein the first stiffener extends further into the inside portion of the container than the second stiffener.

6. The shipping container of claim 1, wherein a height of the top side beam is at least 100 mm.

7. A shipping container with a top side beam, the top side beam comprising:

an open-sided beam comprising a web which includes:

a vertical web plate extending vertically along a height direction of the container, the vertical web plate comprising a stiffener extending a length of the web plate;

a lower wing plate connected to a lower portion of the vertical web plate, a first portion of the lower wing plate being substantially flat and extending perpendicular to the vertical web plate in a horizontal direction towards an inside portion of the container, a second portion of the lower wing plate being connected to the first portion and being rolled back towards the vertical web plate and downward onto the first portion, and the lower wing plate being fixedly connected to a side plate of the container; and an upper wing plate connected to an upper portion of the vertical web plate, the upper wing plate extending perpendicular to the vertical web plate in a horizontal direction towards the inside portion of the container, and the upper wing plate being fixedly connected to a top plate of the container.

8. The shipping container of claim 7, wherein the stiffener is a first stiffener, and wherein the vertical web plate comprises a second stiffener extending the length of the web plate.

9. The shipping container of claim 8, wherein each of the first stiffener and the second stiffener is configured to extend into the container.

10. The shipping container of claim 9, wherein each of the first stiffener and the second stiffener comprises a rectangular profile.

11. The shipping container of claim 10, wherein the first and second stiffeners are equal in size.

12. The shipping container of claim 11, wherein the upper wing plate is substantially flat.

13. The shipping container of claim 12, wherein a height of the top side beam is at least 100 mm.

14. A shipping container with a top side beam, the top side beam comprising:

an open-sided beam comprising a web which includes:

a vertical web plate extending vertically along a height direction of the container, the vertical web plate comprising first and second stiffeners extending a length of the web plate, each of the first stiffener and the second stiffener being equal in size, having a rectangular profile, and extending beyond a surface of the vertical web plate into the container;

a lower wing plate connected to a lower portion of the vertical web plate, a first portion of the lower wing plate being substantially flat and extending perpendicular to the vertical web plate in a horizontal direction towards an inside portion of the container, a second portion of the lower wing plate being connected to the first portion and being rolled back towards the vertical web plate and downward onto the first portion, and the lower wing plate being fixedly connected to a side plate of the container; and an upper wing plate connected to an upper portion of the vertical web plate, the upper wing plate extending perpendicular to the vertical web plate in a horizontal direction towards the inside portion of the container, and the upper wing plate being fixedly connected to a top plate of the container.

15. The shipping container of claim 14, wherein a height of the top side beam is at least 100 mm.

16. The shipping container of claim 1, wherein a height of the top side beam is between 150 mm and 400 mm.

* * * * *